United States Patent [19]

Prins

[11] 4,015,399

[45] Apr. 5, 1977

[54] BUILDING, METHOD AND APPARATUS FOR THE CONSTRUCTION THEREOF

[75] Inventor: Pier Prins, Damwoude, Netherlands

[73] Assignee: Prins N.V., Dokkum, Netherlands

[22] Filed: Dec. 31, 1974

[21] Appl. No.: 537,828

[52] U.S. Cl. ..... 52/747; 52/92; 52/293; 52/282

[51] Int. Cl.[2] ..... E04B 1/14

[58] Field of Search ..... 52/22, 90, 92, 294, 52/295, 495, 732, 738, 741, 601, 282, 747, 730, 293

[56] References Cited

UNITED STATES PATENTS

| | | | |
|---|---|---|---|
| 1,154,204 | 9/1915 | Page | 52/760 |
| 1,253,763 | 1/1918 | Zahner | 52/86 |
| 1,850,118 | 3/1932 | Meyers | 52/665 |
| 1,999,741 | 4/1935 | Schultz | 52/601 |
| 2,091,061 | 8/1937 | Waugh | 52/601 |
| 2,117,996 | 5/1938 | Stromberg | 52/295 |
| 2,356,309 | 8/1944 | Garbe | 52/90 |
| 2,363,164 | 11/1944 | Waller | 52/732 |
| 2,950,786 | 8/1960 | Markle | 52/220 |
| 3,203,145 | 8/1965 | Raynes | 52/22 |
| 3,611,667 | 10/1971 | Maxwell | 52/747 |
| 3,656,270 | 4/1972 | Phillips | 52/732 |
| 3,708,932 | 1/1973 | Bailey | 52/495 |
| 3,882,592 | 5/1975 | Mooney | 52/747 |

*Primary Examiner*—Price C. Faw, Jr.
*Assistant Examiner*—Henry Raduazo
*Attorney, Agent, or Firm*—Cushman, Darby & Cushman

[57] ABSTRACT

A building is constructed by utilizing pre-fabricated elements with the load carrying and supporting sections being constructed of hat-shaped sections generally U-shaped in cross section. A plurality of these hat-shaped sections having at least one upwardly extending flange are secured around a floor member so that the flanges extend vertically from the floor. A series of other hat-shaped sections are then secured to the vertically extending flanges, at their basis and disposed peripherally in spaced parallel relation extending upwardly from the floor. Wall panels are then secured between adjacent vertical hat-shaped sections and additional hat-shaped sections constituting wall plates are placed on top of the wall panels and vertically extending hat-shaped sections. A series of tie-beams are then disposed on top of the wall plates adjacent opposing vertically extending hat-shaped sections. Roof support beams also having a generally U-shaped cross section are then secured to the top of the wall plates in parallel relation thereto and anchor means are then provided to secure the roof support pieces, tie-beams and wall plates together. Roof beams are then secured to the roof support pieces and roof panels placed thereon, completing the construction of a rigid building.

6 Claims, 9 Drawing Figures

BUILDING, METHOD AND APPARATUS FOR THE CONSTRUCTION THEREOF

This invention relates primarily to a method of creating a building essentially from pre-fabricated elements comprising steel carrying and supporting sections and wall, ceiling, floor, roof and like panel members.

One object of the invention is to provide a method of rapidly creating, at low cost, simple, yet soundly constructed buildings, in particular houses, from factory-made parts which can be assembled on the site in a simple manner, in particular special steel sections in a small assortment, and some auxiliary pieces, which can all be made in the factory, so that full profit can be drawn from mass manufacture and, especially also in developing countries and tropical areas, rational application is possible, and in which the bare minimum of separate fastening means is used for securing the component elements together.

According to one aspect of the present invention, there is provided a method of erecting a building essentially from pre-fabricated elements comprising steel carrying and supporting sections and wall, ceiling, floor, roof and like panel members, characterized by using for said carrying and supporting sections rolled hat-shaped sections generally U-shaped in cross-section and each having at least one outwardly extending flange, the floor being peripherally embraced by such hat sections, securing stiles formed by hat sections having profiled legs on the flanges extending vertically upwardly from said floor embracing sections, peripherally clamping wall panels between said stiles by securing retaining strips on the profiled legs of the sections constituting said stiles, holding opposing stiles mutually together with tie-beams constituted by hat sections, and anchoring roof carrying sections to said stiles by means of anchors extending at the top thereof.

The floor can be made on the site, for example, as a reinforced concrete floor extending into the openings of the floor embracing sections, the latter being placed on edge, or alternatively with a frame having wooden cross-beams and floor slabs taken up in said frame.

The positioning of the stiles and then the wall panels between them, the latter being either clamped direct in the openings formed by the stile sections or retained by retaining strips to be attached to the stiles, then the coupling of the stiles by placing the ceiling tie-beams upon them, and the anchoring of the roof carrying sections, between which finally the roof panels are laid, can be performed without difficulty in a very short period of time even by unskilled labour.

Provisions such as conduits can be housed within the hat-sections behind cover strips attached to them. A further important feature is that the hat sections have some resiliency, which enables them to compensate for minor variations in thickness of the panels to be received therein, resulting, for example, from variations in temperature or from moisture.

In an advantageous embodiment according to the invention, hat-section wall plates are clamped on to the wall elements, said wall plates overlying the stiles and having holes therein through which extend the anchors referred to.

All of these method steps for erecting a building according to the invention are so simple of performance as to enable them to be carried out by unskilled labour.

In a preferred embodiment of the invention, ceiling tie-beams constituted by hat sections are laid upon inwardly extending end flanges of the wall plates consisting of hat sections, and ceiling panels are laid on flanges of said tie-beams.

For purposes of rapid assembly, the stiles can be anchored to the wall plates and the roof carrying sections by driving home wedges inserted through holes in the upper ends of the anchors extending at the top of the stiles, which are also inserted through fitting openings of the webs of U-sections resting on said wall plates, the roof carrying sections being secured against the upright legs of said U-section.

In a further elaboration of the principle according to the present invention, by driving home the wedges it is also accomplished that the stiles of opposite walls of the building are effectively coupled together, owing to the fact that a plate member supported on the wall plate, and which may for example be the web of one of the U-sections referred to, has a lip cut out from it and bent downwardly, said lip being inserted in a fitting recess in the terminal portion of the web of a ceiling tie-beam provided at that point. In this way the plate member, i.e. the web of the U-section, shifted with a fitting opening on to the stile anchor and engaging with its bent lip into the recess of the ceiling girder, provides an effective mutual coupling, locked by the wedge, of the stiles incorporated in the opposite walls.

The invention further relates to hat sections for use in the above-described methods and further elaborations thereof.

In particular, according to one embodiment of the invention the hat sections used for the stiles have a bottom portion, two legs and two flanges on the ends of said legs, said legs having an inward indentation adjacent said bottom and an outward indentation adjacent said flanges, said flanges being bent over outwardly and curved back diagonally and having an inwardly bent terminal edge.

The longitudinal indentations in the legs adjacent the bottom or web of the section can be used for securing clamps behind which conduit and like provisions to be housed within the stiles are retained.

The longitudinal indentations in the legs adjacent the ends thereof can be used, for example, for clamping hanger elements of furniture and other equipment.

In another advantageous construction according to this invention, two of such hat sections are connected together back to back, for example, by welding, so that wall panels can be clampingly and somewhat resiliently received between said inwardly curved terminal edges and other wall panels between the legs of each section, the dimensions being such that all said panels may have the same thickness and be equally deeply inserted.

The indentations in the legs of the sections promote the resiliency of the legs themselves and of the curved-back flanges.

According to the invention, another embodiment of a hat section for use as a stile, wall plate, ceiling tie-beams etc. has an inward indentation adjacent to the bottom and an inward indentation adjacent the end of the legs, and flanges extending outwardly and substantially parallel to said bottom with a free terminal edge slightly turned up in the direction of the bottom. This turned-up terminal edge provides for line contact of the flange with the ceiling panel resting upon it, which is more satisfactory from an esthetical point of view than surface-to-surface contact between the flange and the ceiling panel in that it prevents chinks between them.

Hat sections for use as floor embracing sections are preferably formed with a web, a first leg extending at right angles to said web, and a second leg extending diagonally outwardly to substantially the same level as said first leg and having a substantially Z-shaped, outwardly extending flange at its upper end. When the section is installed as a floor embracing section, the diagonal leg and the centre portion of the flange define a space widening outwardly and having a sloping bottom, and in which no moisture can collect.

The invention also relates to a building, in particular a house, erected by the invented method and/or using the invented sections.

The invention will now be described in more detail with reference to the accompanying drawings. In said drawings, FIG. 1 is a perspective view of a house constructed by the method of the present invention;

Figure 1:
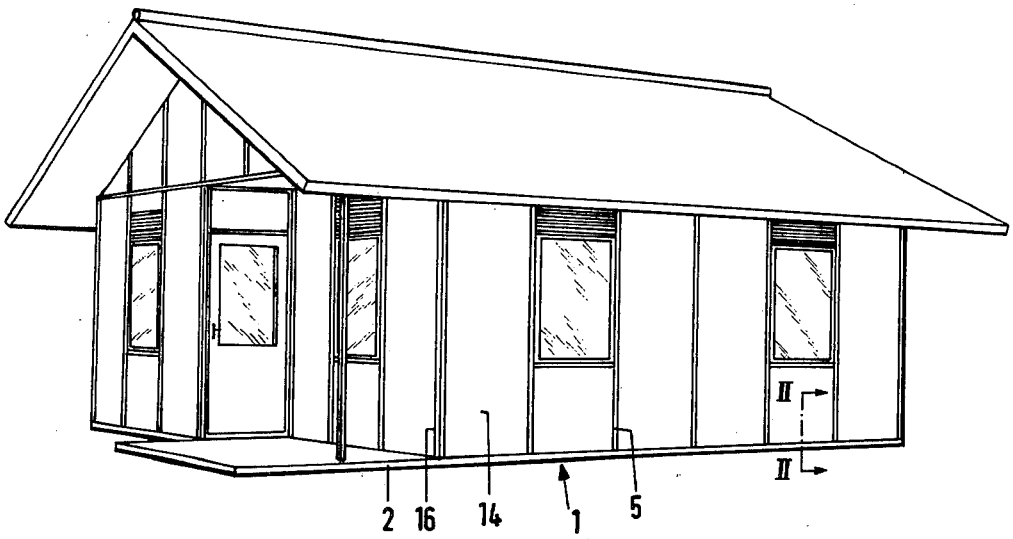
Figure 2:
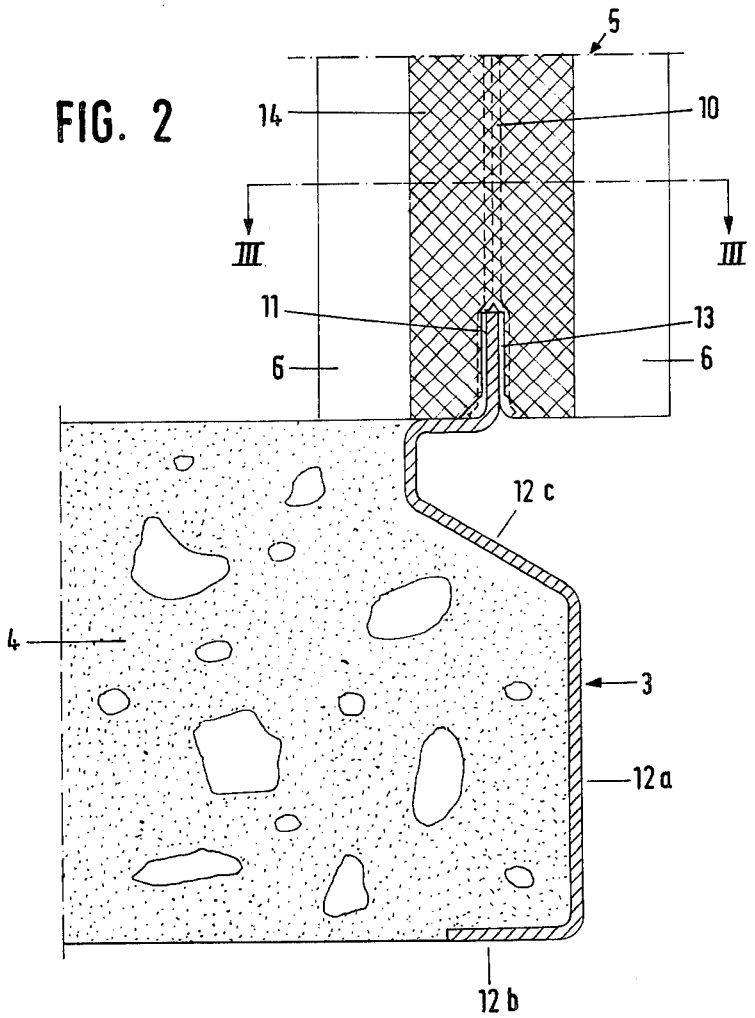
FIG. 2 is a part-sectional elevation on the lines II—II of FIG. 1.

As shown in FIG. 1 there is generally indicated by reference numeral 1 a house made through application of the invented method and hat-sections proposed for the purpose according to the present invention. There is formed from sections 3 of a configuration as shown in FIG. 2 a floor embracing frame 2. The floor embracing sections 3 are hat-shaped with a web 12*a*, a first leg 12*b* extending at right angles to it at its one side edge — the lower one in FIG. 2, and a second leg 12*c* at its other side edge extending diagonally upwardly and outwardly therefrom to a height corresponding to said leg 12*b*, leg 12*c* being provided at the top — at the right-hand side in FIG. 2 — with an outwardly extending flange substantially Z-shaped in section so that the terminal edge 13 of the flange extends parallel to the web, at about half the height of the two legs 12*b*, 12*c* — vertically upwardly in FIG. 2. On, and extending into the "hats" of sections 3 of the floor embracing frame 2, there is poured a concrete floor slab 4, where necessary on a previously applied simple foundation not shown.

Figure 3:
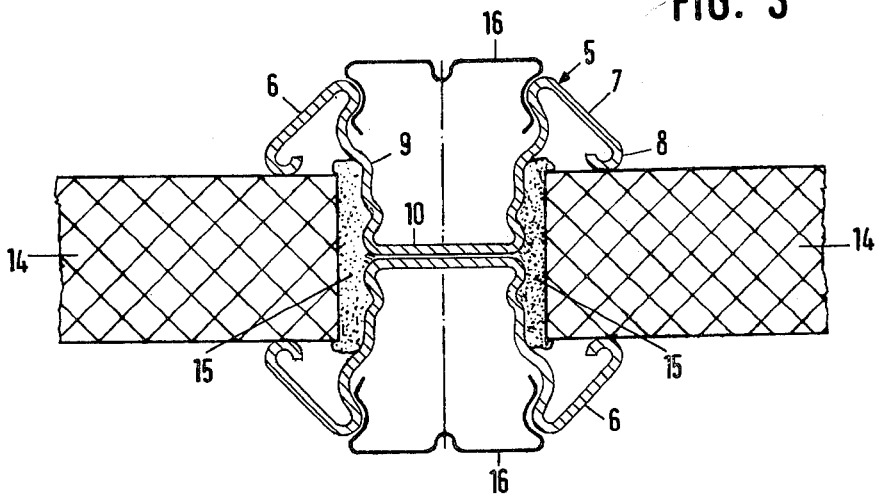
FIG. 3 is a horizontal section on the line III—III of FIG. 2, showing a double stile with wall panels clamped therein.

Stiles 5, each formed of two hat sections 6 attached with their webs 10 to one another in back-to-back relationship, with — as shown in FIG. 3 — on either side of legs 9, diagonally curved-back flanges 7 and hook-shaped, inwardly turned-up end edges 8, are attached in spaced-apart relationship to the upper, vertically extending edge 13 of the floor embracing section 3 of the frame 2. For that purpose webs 10 of sections 6 are indented at the bottom as shown at 11, so that edge 13 fits just between them.

Between edges 8 of the stiles there are accommodated, as shown in FIG. 3, wall panels 14, which are slightly clamped by said edges 8. At 15 are shown in FIG. 3 sealing strips between the peripheral edges of the panels 14 and the legs 9 of the combined stile sections 6.

The apertures of the U portions of hat sections 6, as shown in FIG. 3, are closed with cover strips 16 resiliently snapped with their side edges between the longitudinal indentations in the U-shaped legs 9.

Figure 4:
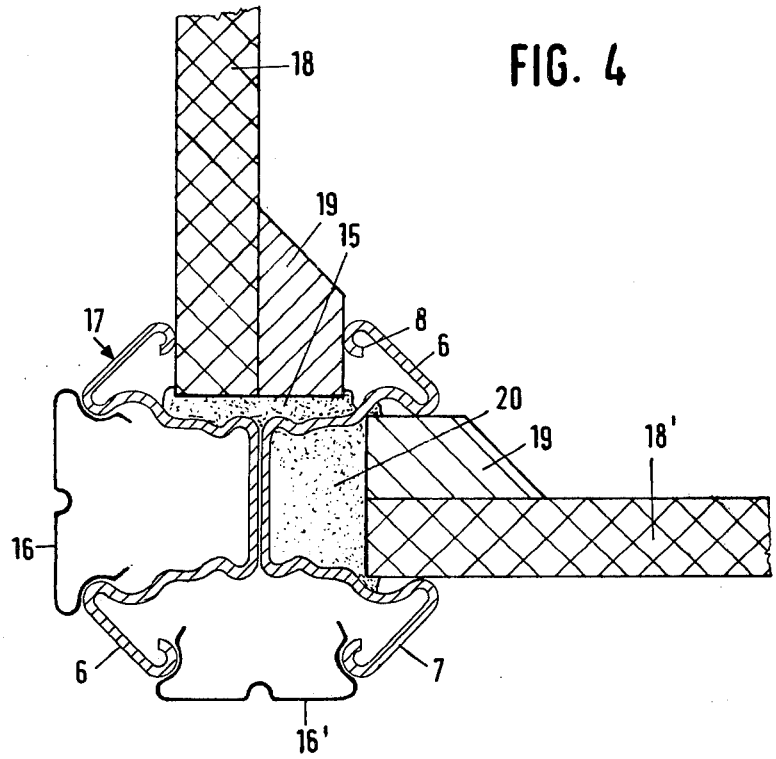
FIG. 4 is a horizontal section of a corner stile from two hat sections similar to those of FIG. 3, but using different wall panels.

The corner stile 17 shown in FIG. 4 also comprises two hat sections 6 as described for wall stile 5, there being applied, by way of a variant, wall panels 18,18′ which are thinner than wall panels 14 shown in FIG. 3, with filling strips 19 where they are embraced by corner stile 17. Wall panel 18′ is accommodated with its associated filling strip 19 in the cavity of the U-portion of one of the two hat sections 6 of corner stile 17. Said hat sections 6 — as shown in FIG. 4 — are so constructed that the aperture of the U-portion of each hat section separately has the same width as, and at its aperture edges is correspondingly profiled to the apertures formed between the hooked edges 8 at the side flanges 7 of the two hat sections 6. Accordingly panels of equal thickness can be clampingly held in two types of apertures and extending therein to the same depth in both cases. Likewise cover strip 16′ in FIG. 4 is identical to strip 16. Only the packing 20 in the U-cavity of the one hat section 6 shown in FIG. 4 has a different cross section than packing 15.

Figure 5:
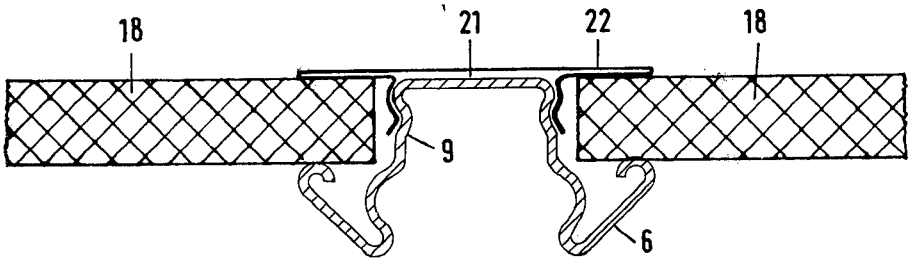
FIG. 5 is a view similar to FIG. 3, showing a stile formed of one single hat section, and showing, in cross-sectional view of a roof girder with adjacent sheeting.

FIG. 5 shows a variant embodiment of a wall stile 21 comprising in this case only a single hat section 6 similar to those used for the "double" stiles 5 and 17. The cover strip 22 snapped onto the inner or house side opposite to the aperture of the hat section 6, has the function to cover the joints between the upright terminal edges of panels 18 and the adjoining legs 9 of hat section 6. For that purpose cover strip 22 is snapped with resilient cross edges onto the longitudinal indentations of legs 9 adjacent the bases thereof. It is also possible to apply a cover strip without snap-on profiles, which may be spot welded with its central area to web 21 of hat section 6.

Figure 6:
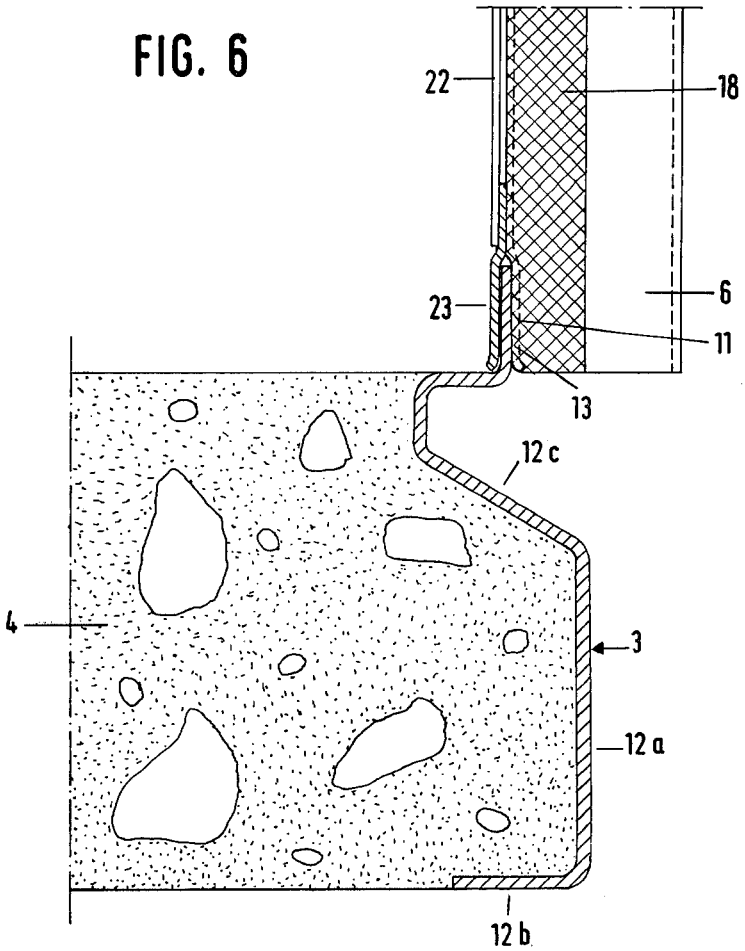
FIG. 6 is a view similar to FIG. 2, but showing a stile formed of a single section in accordance with FIG. 5.

FIG. 6 shows a variant embodiment for a connection of a "single" stile, i.e. one formed by a single hat section — as stile 21 shown in FIG. 5 — to floor embracing section 3 for a concrete floor 4. Here, too, the web of the stile is the bottom, at reference numeral 11, provided with an indentation for this purpose, off-set relative to the remainder of the web of the stile. In the recess thus formed at the back of the web there extends upwardly the vertical terminal edge 13 of the floor embracing section 3. On the inside of the house, to the left in FIG. 6, this edge 13 is substantially flush with the flat inner boundary of cover strip 22. By reference numeral 18 there is indicated a wall panel and by 23 an attachment clamp for the stile section 6 or the terminal edge 13 of section 3.

Figure 8:
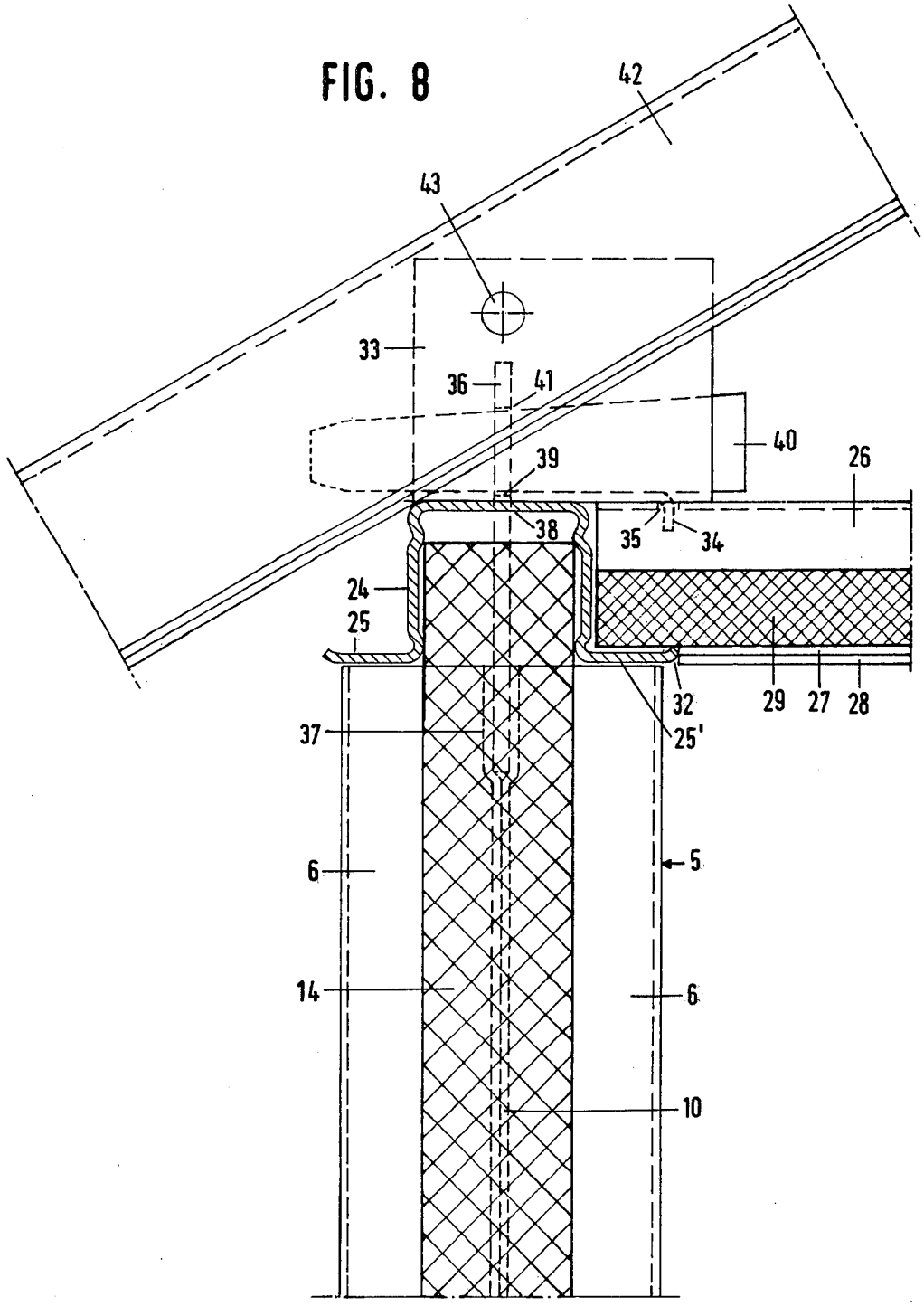
FIG. 8 is a vertical cross-sectional view of a wall plate secured to a double stile according to FIG. 3 with adjacent ceiling and roof portions.
Figure 9:
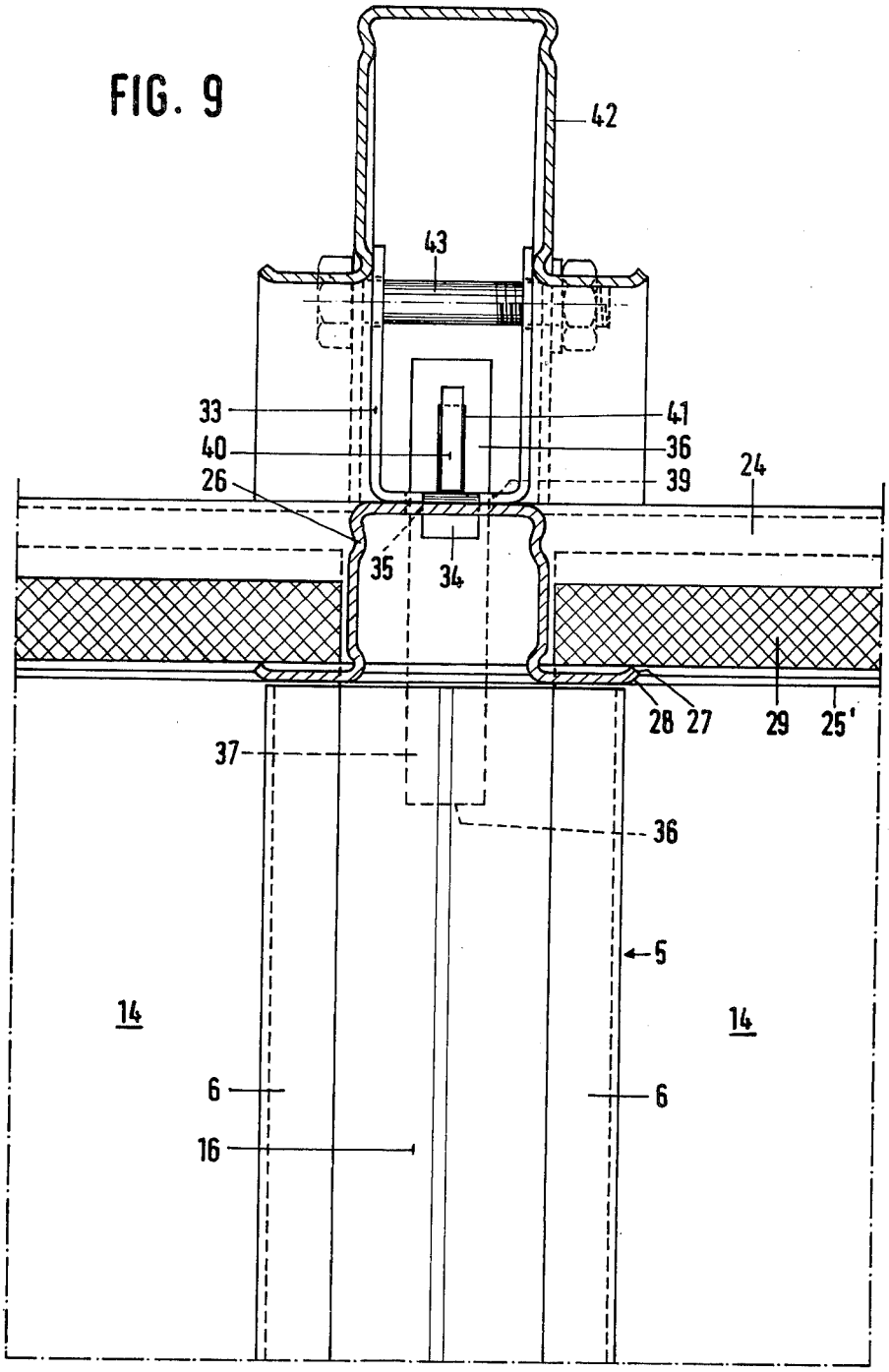
FIG. 9 is a vertical cross-sectional view of a roof beam, roof support beam, wall plates and tie beam according to the present invention.

As shown in FIG. 8 the side walls are covered at the top by a wall plate consisting of a hat section 24, which in its U-section accommodates the upper edges of wall panels 14. The outer and inner side flanges 25, 25′, which are at right angles to the U-legs, have a support on the upper head ends of stiles 5, formed by the pair of hat sections 6.

Figure 7:
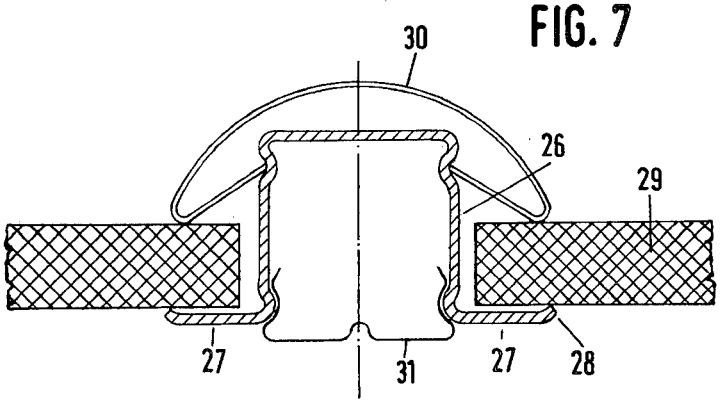
FIG. 7 is a cross-sectional view of a hat-shaped ceiling girder section, showing portions of ceiling elements resting on it.

The ends of ceiling tie-beams 26, consisting according to FIG. 7 of the same hat sections as the wall plate 24, have — a support on the inner side flange 25'. The tie-beams carry on their horizontal side flanges 27, which at 28 at the terminal edges are slightly turned up, ceiling panels 29. These are retained thereon by resilient snap-on strips 30 of a configuration as shown in FIG. 7. Diagonally upwardly and inwardly extending flanges of strips 30 are supported with their ends in longitudinal indentations formed adjacent the bases of the U-legs of the tie-beams 26.

The apertures at the bottom of said tie-beams 26 are covered with resilient cover strips 31 which, with their profiled, upwardly extending legs are snapped on to longitudinal indentations formed adjacent said apertures in the U-legs of the tie-beams, as shown in FIG. 7.

To ensure that the ceiling plates 29 have an equally high support all around, part of the flanges has been removed at each support end of the tie-beam 26, as shown at 32 in FIG. 8. Thus upper boundaries of the tie-beams 26 formed by the backs of the U-webs and the wall plates 24 are also flush. It is also possible, instead of removing part of the flanges of the tie-beams, to indent said flanges adjacent their outer ends over the thickness of the inner flanges 25'. To avoid trouble from upturned terminal edges 32, preferably the outer half of the flange 25' is removed in such embodiment in places where the tie-beams are contiguous thereto. This has the additional advantage that as a result the outwardly extending flanges of the tie-beam hat sections may come to bear direct on the top ends of the stile sections 6.

At the junction of the tie-beam 26 and wall plate 24 there is positioned, as shown in FIG. 8, a roof support beam 33 generally U-shaped in cross section having an upwardly directed aperture.

A lip or tongue 34 has been cut and bent downwardly from the web, the back of the web being supported on the backs of the webs of wall plate 24 and tie-beam 26, said lip or tongue projecting through a fitting cross slot 35 formed in the web of the tie-beam 26.

At the top ends of the hat sections 6 of the stile 5 the webs 10, at 37 in FIG. 8, are slightly indented relative to the remainder of said webs. Between these indentations has been fittingly welded an anchoring strip 36. The latter extends vertically upwardly through a fitting slot 38 in the web of the wall plate 24 and a fitting slot 39 in the web of the U-shaped roof support pieces 33. By means of a wedge 40, which extends through a hole 41 into the anchoring strip 36, wall plate 24, stile 5, tie-beam 26 and roof support beam 33 are solidly interconnected. It will be clear that in this way there is also simply realized a solid mutual coupling, via the tie-beams anchored with their ends to the wall plates, of the oppositely positioned side walls of the house.

The legs of the roof support pieces 33 extend upwardly into the aperture of an upwardly inclined roof beam 42, likewise formed by a hat section, which is attached thereto by means of a bolt 43 projecting through the legs of hat section 42 and roof support beam 33.

The flanges of roof beam 42 provide support for roof panels or slabs not shown in FIG. 8.

It will be clear that the invention is not limited to the embodiment described above and shown in the drawings but that all kinds of variants are possible without departing from the scope of the present invention.

What is claimed is:

1. A method of erecting a building essentially from pre-fabricated elements comprising steel carrying and supporting sections and wall, ceiling, floor, roof and the like panel members, wherein the carrying and supporting sections are generally U-shaped in cross section and formed with at least one end flange extending generally outwardly from the end of at least one of the legs of said U-shaped sections, comprising:

securing first ones of said sections having a single end flange, peripherally embracing the floor so that said single end flange of each extends upwardly from the floor;

securing stiles to said single end flange of said first ones of said sections so as to extend upwardly from the floor, said stiles being formed by second ones of said sections having two legs each formed with an end flange extending generally outwardly from the end thereof;

peripherally clampingly engaging wall panels between laterally spaced adjacent stiles for the former to be retained therebetween;

securing anchor means to the upper portion of the stiles, said anchor means having a vertically extending upper portion;

securing tie beams between upper portions of opposing stiles in engagement with the upper portion of the anchor means so as to hold the stiles mutually together, said tie beams comprising third ones of said sections having two legs each formed with an end flange extending generally outwardly from the end thereof, said legs extending downwardly;

clampingly engaging wall plates to the upper margins of the wall panels so as to overlie the upper ends of the stiles with the upper portion of the anchor means extending through the wall plates, said wall plates being formed by fourth ones of said sections having two legs each formed with an end flange extending generally outwardly from the downwardly extending legs; and anchoring roof beams comprising fifth ones of said sections to the upper portion of the anchor means for supporting roof panels thereon, each of said fifth ones of said sections having two legs each formed with an end flange extendng generally outwardly from the end thereof and said legs extending downwardly.

2. A method according to claim 1, which comprises placing in a supporting manner further ceiling tiebeams on inwardly extending end flanges of the wall plates, and placing in a supporting manner ceiling panels on the end flanges of the tie-beams.

3. A method of erecting a building essentially from pre-fabricated elements comprising steel carrying and supporting sections and wall, ceiling, floor, roof and the like panel members, wherein the carrying and supporting sections are generally U-shaped in cross section and formed with at least one end flange extending generally outwardly from the end of at least one of the legs of said U-shaped sections, comprising:

securing first ones of said sections having a single end flange, peripherally embracing the floor so that said single end flange of each extends upwardly from the floor;

securing stiles to said single end flange of said first ones of said sections so as to extend upwardly from the floor, said stiles being formed by second ones of said sections having two legs each formed with an end flange extending generally outwardly from the end thereof;

peripherally clampingly engaging wall panels between laterally spaced adjacent stiles for the former to be retained therebetween;

securing anchor means to the upper portion of the stiles, said anchor means having a vertically extending upper portion;

securing tie beams between upper portions of opposing stiles in engagement with the upper portion of the anchor means so as to hold the stiles mutually together, said tie beams comprising third ones of said sections having two legs each formed with an end flange extending generally outwardly from the end thereof, said legs extending downwardly;

clampingly engaging wall plates to the upper margins of the wall panels so as to overlie the upper ends of the stiles with the upper portion of the anchor means extending through the wall plates, said wall plates being formed by fourth ones of said sections having two legs each formed with an end flange extending generally outwardly from the downwardly extending legs; and anchoring roof beams comprising fifth ones of said sections to the upper portion of the anchor means for supporting roof panels thereon, each of said fifth ones of said sections having two legs each formed with an end flange extending generally outwardly from the end thereof and said legs extending downwardly;

the anchoring of the stiles with the wall plates and the roof carrying fifth ones of said sections being effected by driving home wedges inserted through holes in the upper ends of the anchor means extending at the top of the stiles, which anchor means are also inserted through fitting openings in the webs of roof support pieces having a U-shaped cross section resting with their webs on the wall plates, and wherein the roof carrying fifth ones of said sections are secured to the upright legs of the roof support pieces;

the web portion of the roof support pieces supported on the wall plates has a lip or tongue cut out from it and bent downwardly, which lip or tongue is inserted into a fitting recess in the end portion of the web of a tie-beam, while the roof support piece is positioned on the anchor means extending from the stile by an opening in its web fitting said anchor means.

4. A stile for use in constructing a building or the like, formed from two sections, each section having a web portion, two legs and two end flanges on the ends of said legs, said legs having an inward indentation adjacent said web portion and an outward indentation adjacent said end flanges, said end flanges being bent over outwardly and curved back diagonally and having an inwardly bent terminal edge, said two sections being connected together with their web portions back-to-back, said sections being shaped and dimensioned so that wall panels can be clampingly and somewhat resiliently received between said inwardly curved terminal edges, and other wall panels between the legs of each section, all of the panels being substantially equally thick and being substantially equally deeply inserted, the web portions of the sections are indented adjacent to the ends of the stile to define slots between them for respectively receiving a flange projecting vertically upwardly from a floor embracing section, and an anchor which, extending upwardly from said slot, can serve for anchoring a roof carrying section.

5. A building comprising:

a floor peripherally embraced by first sections secured thereto, each first section being generally U-shaped in cross section and having at least one end flange extending generally upward from the floor;

a plurality of horizontally spaced vertically extending stiles secured to the upwardly extendng flanges of the first sections, each stile comprising at least one second section having a generally U-shaped cross section with profiled legs and end flanges extending outwardly from the ends of said legs;

wall panels secured to and extendng between adjacent vertically extending stiles;

anchor means secured to the stiles and having a portion extending vertically upward for anchoring roof beams to the stiles;

wall plates comprising beams generally U-shaped in cross section with end flanges at the ends of the legs of said U-shaped sections extending outwardly therefrom, said wall plates being secured to the upper portions of the stiles by the anchor means;

tie-beams having generally U-shaped cross sections with end flanges extending outwardly from the ends of the legs of said U-shaped sections, said tie-beams extending between and coupling upper portions of opposing stiles;

roof support pieces having generally U-shaped cross sections positioned with their web portions secured to and resting on the wall plates, with the legs of the roof support pieces extending substantially vertically upward, and roof beams having a generally U-shaped cross section with end flanges extending outwardly from the ends of the legs of said U-shaped sections, secured at their end portions to the legs of the roof support pieces; and roof panels secured to said roof beams.

6. A building as defined in claim 5 wherein the vertical portions of the anchor means extend through openings in the tie beams and the roof support pieces so as to present portions with apertures therein above the webs of the roof support pieces, wedges secured in the apertures of the anchor means so as to secure the roof support pieces and wall plates to the stiles.

* * * * *